United States Patent [19]

Davies

[11] 4,152,831

[45] May 8, 1979

[54] TOOL HOLDER

[75] Inventor: Peter O. Davies, Auckland, New Zealand

[73] Assignee: Tullen Industries Limited, Auckland, New Zealand

[21] Appl. No.: 859,094

[22] Filed: Dec. 9, 1977

[30] Foreign Application Priority Data

Dec. 15, 1976 [NZ] New Zealand ..... 182894

[51] Int. Cl.[2] ..... B26B 19/38

[52] U.S. Cl. ..... 30/231; 211/60 T; 248/37.6

[58] Field of Search ..... 30/231, 296 A; 211/60 T; 248/37.3, 37.6; 224/2 D, 2 E, 2 F, 3, 5 A, 5 B

[56] References Cited

U.S. PATENT DOCUMENTS

| | | | |
|---|---|---|---|
| 904,968 | 11/1908 | Kocher | 211/60 T |
| 1,427,849 | 9/1922 | Rayder | 224/2 F |
| 3,854,205 | 12/1974 | Boskus | 30/231 |
| 4,043,754 | 8/1977 | Sklar | 211/60 T |

*Primary Examiner*—Jimmy C. Peters

*Attorney, Agent, or Firm*—Holman & Stern

[57] ABSTRACT

A tool holder for a scissor-like tool whose blades are biased to an open position by means of a spring has a portion co-acting with the blades or handles which are forced against that portion to secure the tool in the holder.

14 Claims, 16 Drawing Figures

FIG 10
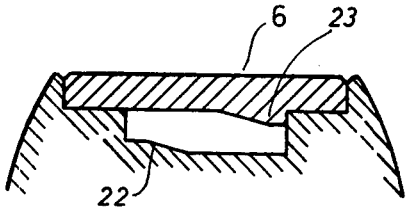
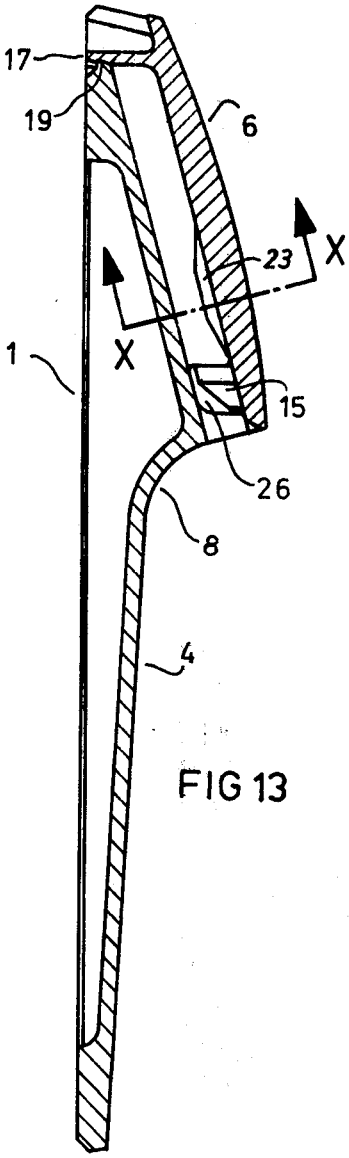
FIG 13
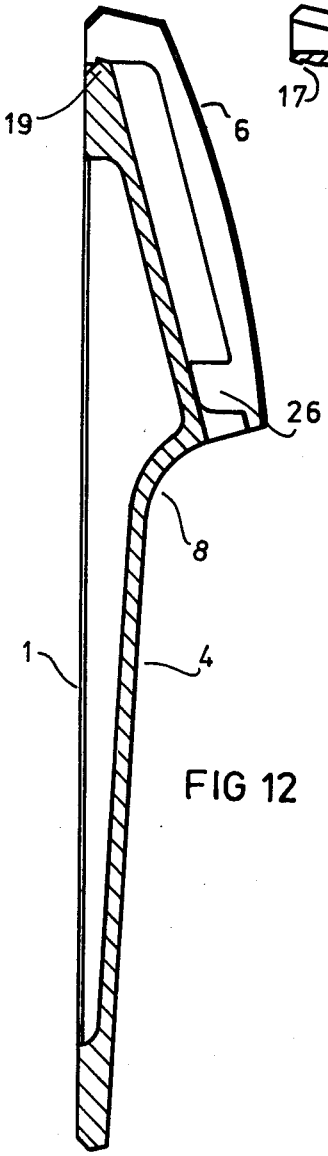
FIG 12
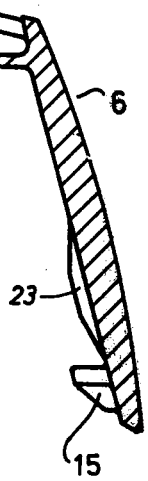
FIG 11

TOOL HOLDER

BACKGROUND OF THE INVENTION

This invention relates to a tool holder which has been devised for holding a scissor-like tool whose blades are biased to an open position by means of a spring. References throughout this specification and claims to "a tool" are references to a tool of this kind.

Hitherto, a clip or lock has been provided to hold the blades of such a tool closed against the bias of the spring for storage purposes. It is, however, difficult to manufacture an effective clip or lock. Also, quite unrelated to that problem, there is the storage problem when such tools are used around the home, especially in the kitchen, where the tool should be readily available for instant use at all times.

The applicant is not aware of any holders designed specifically for spring biased tools. Many gravity holders for non-biased tools are known and these generally take the form of a pocket to receive and protect the blades, e.g. see U.S. Pat. Nos. 1,750,891, 2,508,755 and 2,664,231.

SUMMARY OF THE INVENTION

The tool holder of this invention was devised with the object of providing a holder to store a tool, preferably in such a manner that the blades, and thus the handles, are at least partially closed since this facilitates grasping the tool when it is to be used. The provision of such a holder eliminates the need for a clip or lock since the holder preferably shrouds the blades to prevent accidental contact with them.

The present invention consists in a holder for a scissor-like tool whose reciprocable blades are biased to an open position by means of a spring comprising a mounting portion adapted to be secured to or to rest upon a support and a tool gripping portion adapted to hold a tool in the holder by the spring pressure of the tool causing the tool to co-act against the tool gripping portion.

BRIEF DESCRIPTION OF THE DRAWINGS

Preferred forms of the invention will now be described with reference to the accompanying drawings in which:

FIG. 10 is a partial cross section through the cap when fitted in the plane X—X of FIG. 13, FIG. 11 is a cross sectional view in the plane XI—XI of FIG. 9 of the cap alone, FIG. 12 is a cross sectional view on plane XIII—XIII of FIG. 2 with the cap removed, FIG. 13 is a cross sectional view on plane XIII—XIII of FIG. 2 with the cap fitted.

DESCRIPTION OF THE PREFERRED EMBODIMENTS

Figure 1:
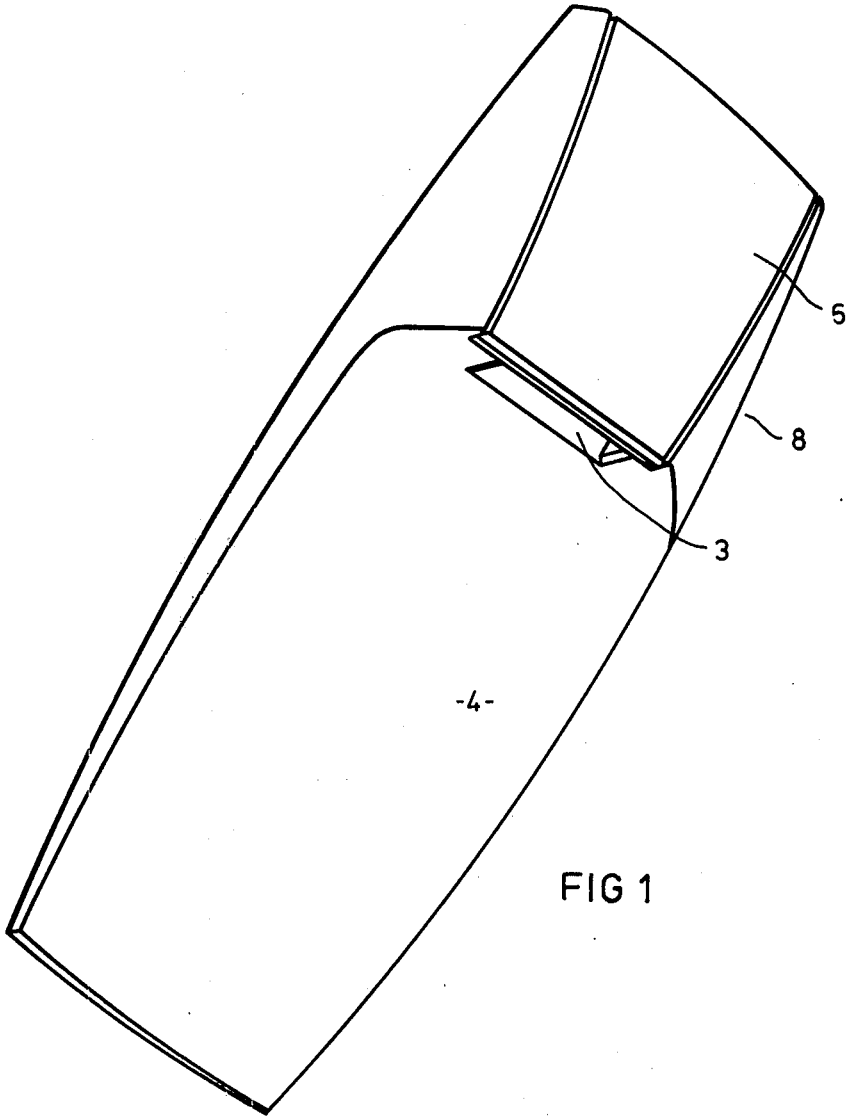
FIG. 1 is a front perspective view of a preferred tool holder.
Figure 2:
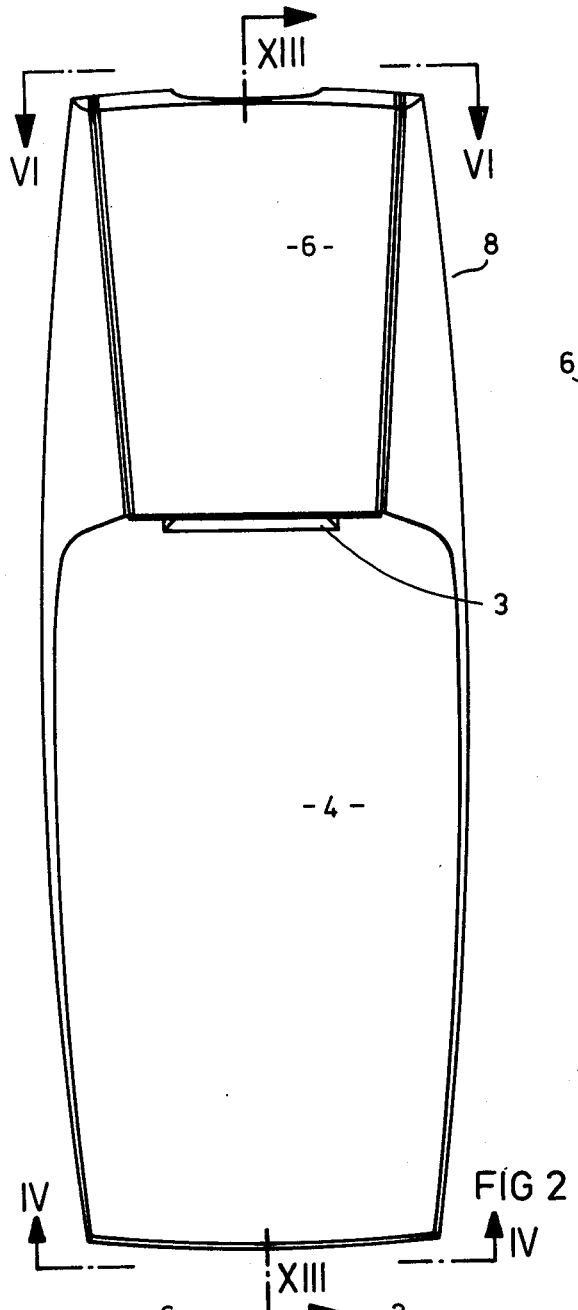
FIG. 2 is a front elevation.
Figure 3:
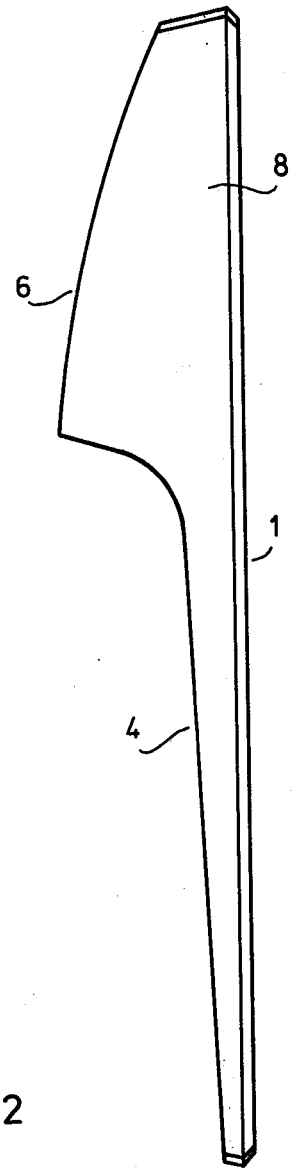
FIG. 3 is a side elevation.
Figure 4:
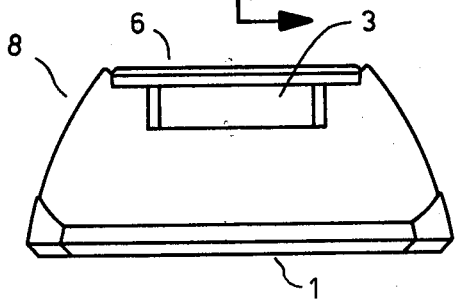
FIG. 4 is an end view in the direction IV—IV of FIG. 2.
Figure 6:
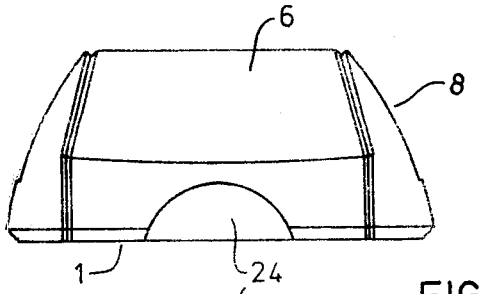
FIG. 6 is an end view in the direction VI—VI of FIG. 2.
Figure 5:
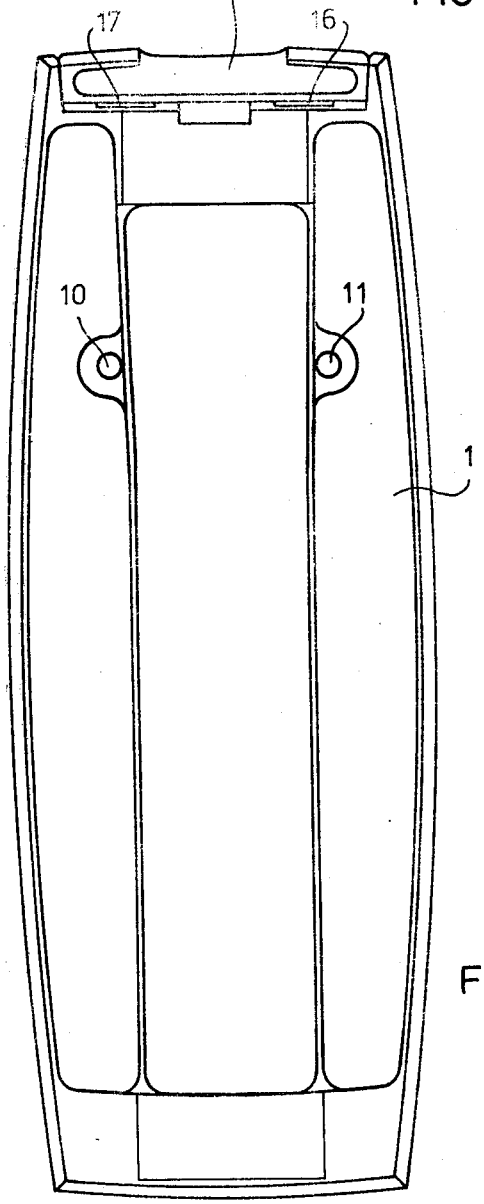
FIG. 5 is a rear elevation.

This invention may take many different forms, many of which will be apparent to those skilled in the art after the principles have been discussed below.

A preferred tool holder is illustrated in FIGS. 1–13 which is capable of either sitting on a horizontal surface by its mounting portion 1, which in that version is a simple planar surface, or being mounted to a vertical surface, e.g. by means of a contact adhesive, by magnetic strips incorporated on the rear surface 1 or by means of screws which may pass through the holes 10 and 11. The article is shaped to facilitate injection moulding from a plastics material such as polypropylene. For this reason the rear surface 1 may have suitable cavities in it.

The holder is provided with a thickened head portion 8 and with a tail portion 4. In the head portion 8 there is a tool gripping portion adapted to hold a tool in the holder by the spring pressure of the tool causing the tool to co-act against the gripping portion. In the preferred embodiment shown the gripping portion is in the form of a slot 3 the cross section of which can be deduced from the drawings, especially FIG. 10. The cross setion of the slot is not uniform but instead is shaped to allow for the fact that the blades 9 of the tool are offset from one another since of course they reciprocate past one another in use to effect a shearing cutting action.

Figure 7:
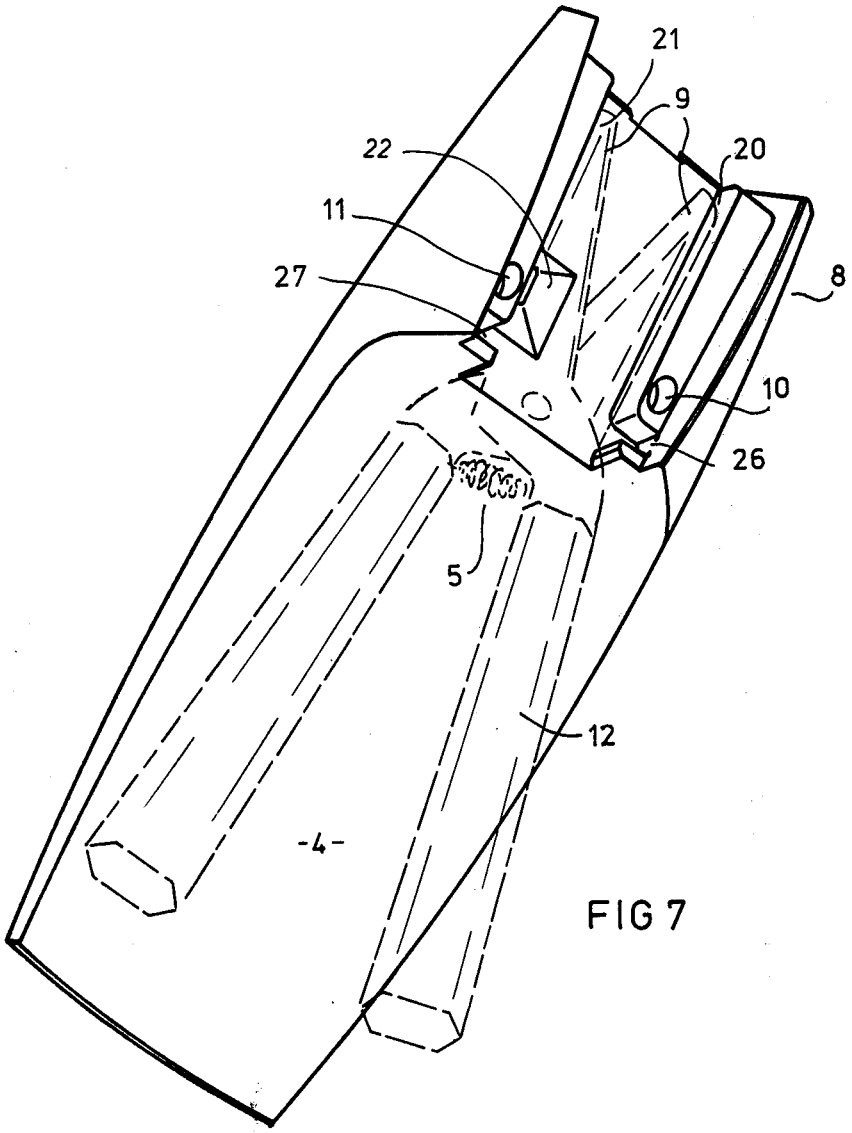
FIG. 7 is a front perspective view with the cap removed and with a tool being shown in dotted outline as fitted to the holder.
Figure 8:
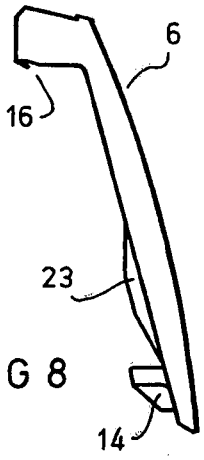
FIG. 8 is a side elevation of the cap.
Figure 9:
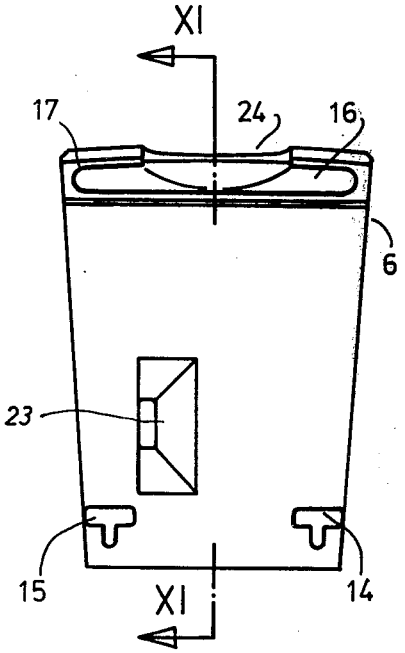
FIG. 9 is an underneath view of the cap.

Referring now to FIG. 7, it can be seen that the tool 12 has its blades 9 located within the slot so that the spring 5 forces them against the walls 20 and 21 which are divergent and lie closer together at the blade entrance. Spacers 22 and 23 in the head 8 and cover 6 respectively allow for the fact that the blades are offset. The entrance apertures to the slot 3 are funnelled by means of small bevels to facilitate entrance of the blades into the slot. It will be apparent that the blades could coact against portions other than walls 20 and 21 with the same general effect, e.g. the blades could co-act with pegs.

In use, therefore, the user having used the tool simply thrusts the blades into the slot, the tool being at least partially closed at this stage, and then releases the handles. The spring force from the spring 5 will thrust the blades apart and will then ensure that the tool remains in the slot. When the tool is required for use the handles are grasped and the tool is withdrawn. It is preferable that the walls 20 and 21 are provided so that the tool, when secured, is neither fully open nor fully shut but is in an appropriate position to be readily grasped. It can also be seen from a study of FIGS. 12 and 13 that the handles of the tool when held in the holder will be angled away from the holder so that they may be readily grasped without the hands being interfered with by the tail portion 4.

While it would be possible to have lugs or similar arrangements to prevent the tool from being removed in a direction perpendicular to the plane of the mounting portion 1, this is preferably achieved by means of a removable cover 6 which usefully conceals the screw holes 10 and 11 and their associated screws and also conceals or shrouds the blades. To facilitate removal of the cover there is a finger aperture 24 (FIG. 6) in the cover. The cover itself is held in place by means of lugs 14 and 15 which co-act with recesses 26 and 27 in the head portion 8 and also by means of hooked portions such as 16 and 17 in the cover which co-act with the corresponding hooked portion or ledge 19 in the head portion 8 so that the cover may be sprung onto the head portion. Obviously there are other ways in which the removable cover could be secured to the head.

The considerable advantages of the preferred form of the invention illustrated are:

(a) the handles of the tool are held at an angle to the holder and are easily accessible and easily grasped, e.g. if the holder is wall mounted the user does not have to wash and/or dry his or her hands first. This should be contrasted with the usual position where such tools are stored in a drawer.

(b) The removable shroud conceals the screw fastenings and also facilitates cleaning. Because it hides away dirt deposited on the holder by the blades and the blades themselves if dirty, some users will find it convenient to put the tool away dirty after its use during the day and to clean the tool and holder once only at the end of a day's work. This can effect a considerable time saving for the user and ensures that the holder is used for its intended purpose - as a handy receptacle for the tool.

(c) The holder can be positioned exactly where it is most convenient. It is easy to keep the tool out of reach of children. The holder works effectively whatever its orientation since it does not rely on gravity to function.

Numerous variations are possible. For example, while the mounting portion 1 has been described as a flat surface it is apparent that it could be in the form of feet or legs etc. It will also be appreciated that the tail portion 4 has little functional purpose and could be entirely dispensed with. Also, it may be desirable in some installations to have a separate bracket which held the holder and from which the holder could readily be removed.

Figure 15:
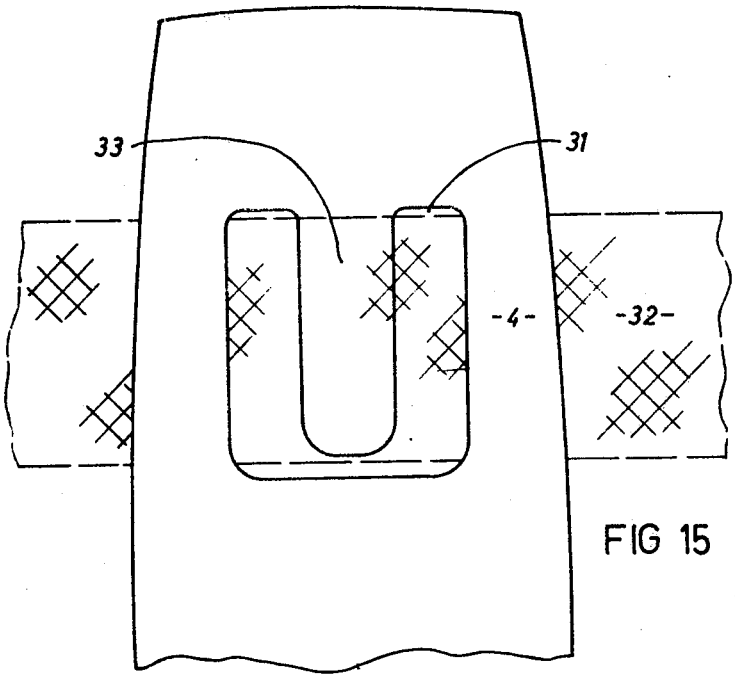
FIG. 15 is an elevation of part of the tail of a tool holder showing a belt slot.

Furthermore, a version suitable for attachment to a tradesman's belt would provide that the handles lay more or less parallel to the plane 1 and as shown in FIG. 15 a slot 31 could be provided to receive a belt 32 and there would preferably be a tongue 33 extending into the slot so that the tool holder could be clipped on the belt without the necessity of threading the belt through it. In such an embodiment the head portion would hang downwardly and need not necessarily be provided with a removable cap. However, if provided with a cap, the form of cap shown would be quite suitable since it will be seen that the lugs 15 are angled with respect to the slots 26 so that attempts to lever off the cover 6 when the toolis inserted into the slot will not be effective. The cover can only readily be removed by using the finger slot 24.

Figure 16:
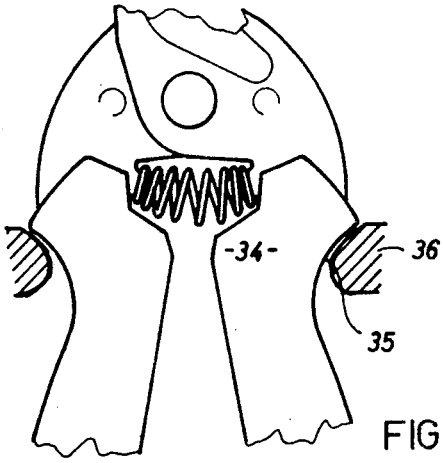
FIG. 16 is a partial elevation of part of a tool in part of a holder showing an alternative means of securing the tool within the holder via the shoulders of the handles.

While it is preferred that it is the blades which are gripped by the tool holder since this leaves the handles completely free for grasping, it is possible to have constructions where the tops or shoulders of the blades are held as shown in FIG. 16. There, the shoulder 34 of the handle is shown with the customary outward flare 35 and prevents the user's fingers from sliding over the upper end of the handle and these flares co-act with the stops 36 which form part of the tool holder. In such a construction the blades if required to be shrouded would simply lie inside a pocket.

From the above description it will be apparent that many variations are possible beyond those described.

Figure 14:
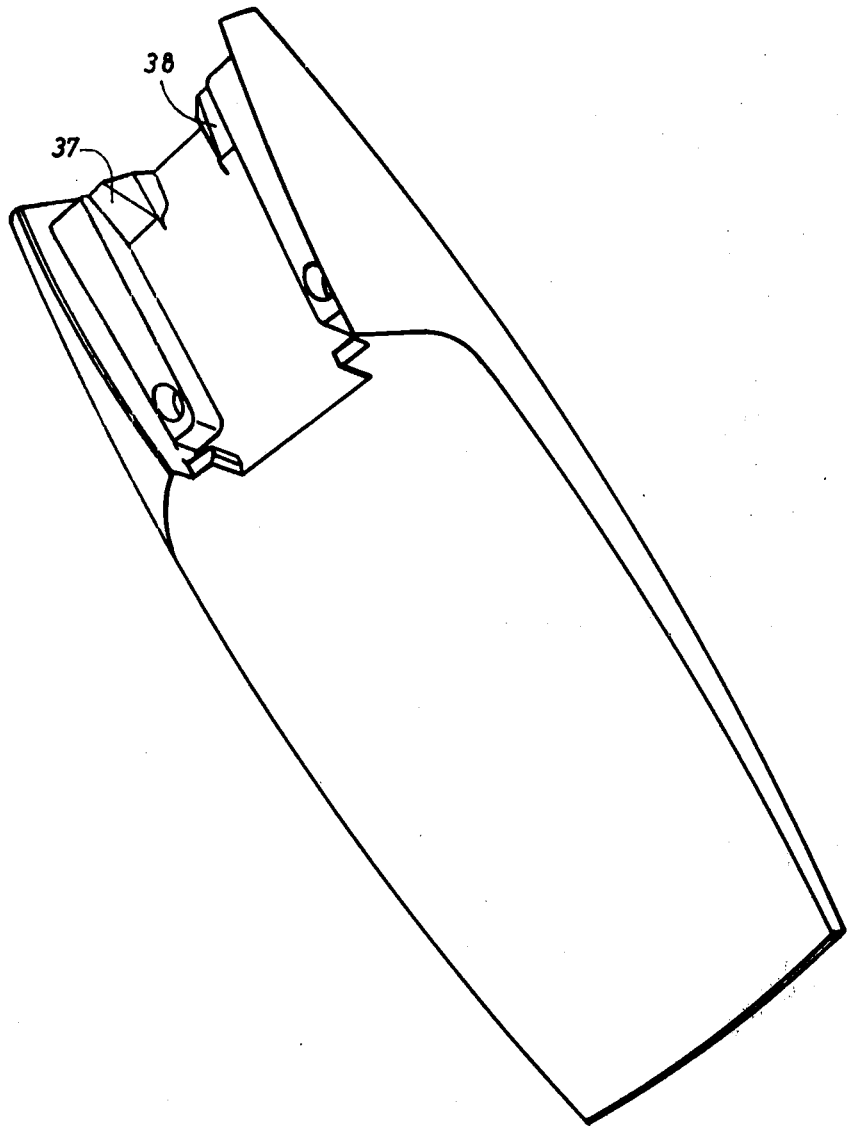
FIG. 14 is a perspective view of part of an alternative tool holder.

An alternative form of head portion is shown in FIG. 14 where spacers 22 and 23 in the head portion 8 and cover 6 can be eliminated. Those spacers serve to hold the tool in correct alignment. Instead, ramps 37 and 38 can be provided in such a manner that the tips of the blades ride up the ramps and proper alignment of the tool, when inserted in the holder, is thereby achieved.

I claim:

1. A holder for a scissor-like tool whose reciprocable blades are biased to an open position by means of a spring comprising a mounting portion adapted to be secured to or to rest upon a support, and a tool gripping portion adapted to hold a tool in the holder by the spring pressure of the tool causing the tool to co-act against the tool gripping portion.

2. A tool holder as claimed in claim 1 such that when a tool is positioned in the holder the tool handles are angled away from the holder so that they may be readily grasped.

3. A tool holder as claimed in claim 2 wherein the tool gripping portion comprises a recess adapted to receive the blades.

4. A tool holder as claimed in claim 3 wherein the recess has walls adapted to co-act with the outer edges of the tool blades and the walls of the recess converge, being closer together at the blade entrance.

5. A tool holder as claimed in claim 4 wherein the walls of the recess hold the blades in a partially closed position.

6. A tool holder as claimed in claim 5 wherein the recess has a removable cover portion which shrouds the blades of the tool.

7. A tool holder as claimed in claim 6 wherein holes are provided for threaded fasteners and said removable cover portion also conceals the holes and any threaded fasteners which may be used to fix the holder to a support.

8. A tool holder as claimed in claim 7 wherein the cover is a "click-fit" on the remainder of the holder.

9. A tool holder as claimed in claim 8 wherein the entrance to the recess is funnelled to provide easy access for the blades of the tool.

10. A tool holder as claimed in claim 9 wherein the mounting portion comprises a substantially planar surface.

11. A tool holder as claimed in claim 1 wherein the tool holder has a head and a tail portion and the head portion is adapted to hold the tool while the tail portion is adapted to be secured to a support in the nature of a belt and is provided with at last one slot therein.

12. A tool holder as claimed in claim 11 wherein a tongue enters into said slot to enable the tool to be clipped to the belt.

13. A tool holder as claimed in claim 1 wherein the tool gripping portion is adapted to hold the tool in the holder by co-acting with the top ends of the handles.

14. A combination of a scissor-like tool whose blades are biased to an open position by means of a spring when secured in a tool holder as claimed in claim 1.

* * * * *